United States Patent [19]

Cordone et al.

[11] 3,948,309

[45] Apr. 6, 1976

[54] COMPOSITE ROTOR HOUSING WITH WEAR-RESISTANT COATING

[75] Inventors: Leonard G. Cordone, Allen Park; Yeshwant P. Telang, Grosse Ile, both of Mich.

[73] Assignee: Ford Motor Company, Dearborn, Mich.

[22] Filed: Aug. 20, 1973

[21] Appl. No.: 390,132

[52] U.S. Cl. ..... 164/98; 29/527.6; 164/9; 164/48; 164/111; 204/9; 204/26

[51] Int. Cl.[2] ..... B22D 19/08

[58] Field of Search ..... 164/19, 20, 59, 69, 98, 164/100, 111, 94, 95, 107, 332, 334, 112, 46, 48, 9, 14, 76; 204/48, 49, 52 R, 40, 9, 26; 29/527.1, 527.3, 527.5, 527.6

[56] References Cited

UNITED STATES PATENTS

| | | | |
|---|---|---|---|
| 3,061,525 | 10/1962 | Grazen | 204/49 |
| 3,083,424 | 4/1963 | Bauer | 164/112 X |
| 3,098,270 | 7/1963 | Bauer | 164/103 |
| 3,293,109 | 12/1966 | Luce et al. | 204/38 E |
| 3,616,288 | 10/1971 | Snauely | 204/26 |
| 3,628,237 | 12/1971 | Zeigler | 29/527.6 |
| 3,640,799 | 2/1972 | Stephan et al. | 204/40 |
| 3,797,101 | 3/1974 | Bauer | 164/46 |
| 3,856,635 | 12/1974 | Brown | 204/9 |

FOREIGN PATENTS OR APPLICATIONS

| | | |
|---|---|---|
| 873,012 | 7/1961 | United Kingdom |

OTHER PUBLICATIONS

"Bonding Cast Iron to Aluminum Castings," Light Metal Age, Oct., 1959, p. 17.

"Aluminum Bonded By Diecasting Process," Stell, Nov. 30, 1959, pp. 98–100.

"Transplant Coated Aluminum Cylinder Bores," Bauer, A. F., Paper No. 369C, 1961 Summer Meeting, Society of Automotive Engineers, 485 Lexington Ave., N.Y., N.Y.

*Primary Examiner*—Roy Lake
*Assistant Examiner*—Paul A. Bell
*Attorney, Agent, or Firm*—Joseph W. Malleck; Keith L. Zerschling

[57] ABSTRACT

A method is disclosed for fabricating a rotor housing for a rotary internal combustion engine. A conductive mandrel is prepared having an outer surface complimentary to the resultant rotor housing inner wall, the mandrel is provided with an exterior surface smoothness in the range of 4–12 r.m.s. A functional coating of a composite particle wear-resistant material is electrolytically deposited onto the mandrel (acting as a cathode) to form an assembly, the exposed surface of the assembly is controlled to have a roughness characterized by projections no less than 0.030 inches and concentrated in a number no less than 5/cm². The assembly is placed in a die-casting machine where a molten metallic medium is cast thereabout forming a casting which is substantially mechanically locked to the assembly. The mandrel is then stripped from the coating to leave the resultant rotor housing. The resultant rotor housing is characterized by wear-resistant inner surface which is almost totally non-porous, its as-deposited surface roughness is at least 24 r.m.s., has a high heat transfer coefficient, is non-brittle and experiences no micro-cracking due to heat checking in service. The composite is economically fabricated and is strongly adherent.

9 Claims, 3 Drawing Figures

FIG. 1.
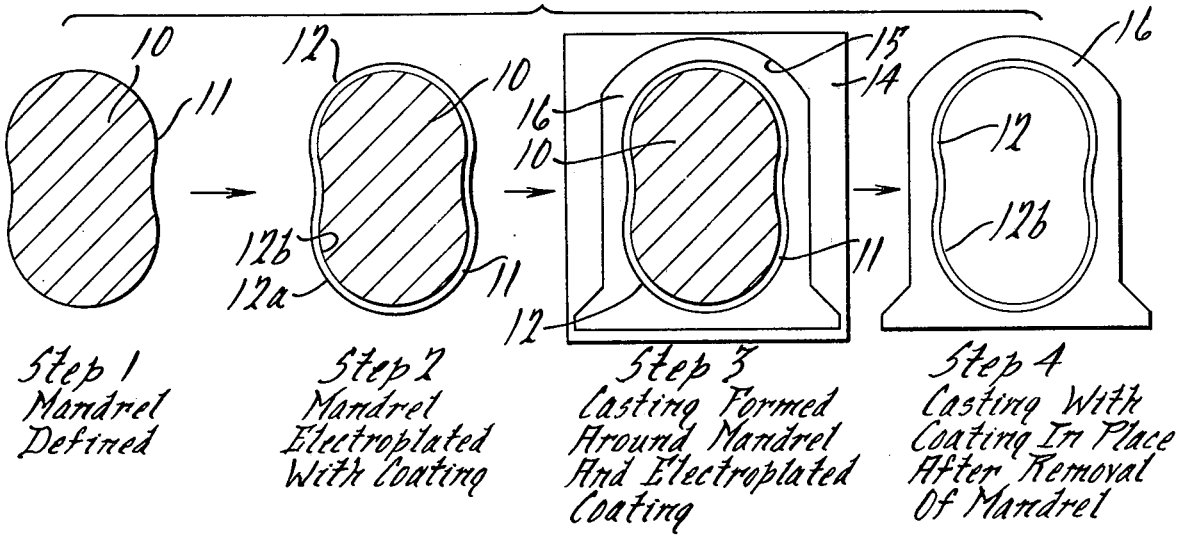
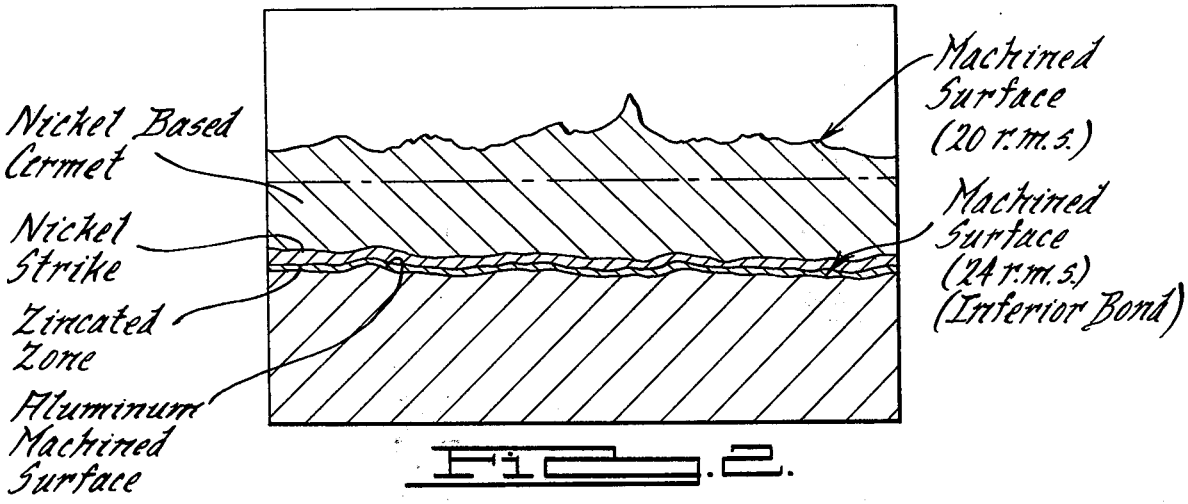
FIG. 2.
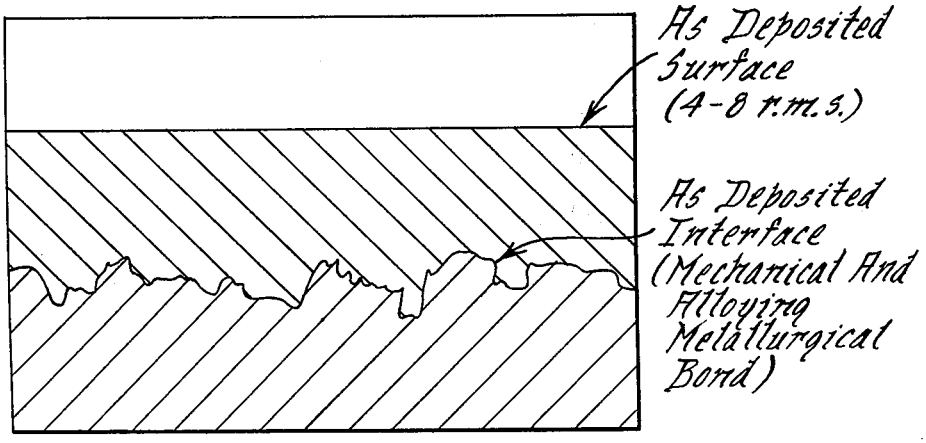
FIG. 3.

COMPOSITE ROTOR HOUSING WITH WEAR-RESISTANT COATING

BACKGROUND OF THE INVENTION

There are several commercial methods for preparing the rotor housing of a typical rotary internal combustion engine. One popular method entails preparation of a core surface which is the mirror image of the intended inner wall of the rotor housing. The core electroplated with a thin coating of chromium over which is flame sprayed powdered plain carbon steel to form a relatively thick porous self-fused coating on the core. The selection of spray coated materials is limited due to the particular technique involved; the material must attempt to provide adherency to the surrounding housing. The spray coating and core are carried as an assembly to a die-casting machine where a mass of aluminum is cast thereabout to form an integral composite. The core then is stripped from the chromium coated liner to leave in tact the composite rotor housing. The principal drawbacks of this transplant technique are: (a) plain carbon steel, not being sufficiently wear-resistant by itself performs only as a metallurgical intermediate for bonding with aluminum, and the chromium coating, serving as the wear-resistant portion, experiences undesirable heat checking; (b) the considerable porosity of the sprayed powdered liner reduces heat transfer through the housing lowering the efficiency of the cooling system. The chromium coating, in addition, is extremely thin and can be easily damaged during assembly and fabrication. The high expense of the multiple steps involved is undesirable.

Turning to another body of technology, the prior art recognizes that a particularly useful material for wear-resistance is that of an electrolytic deposit of a nickel base with suspended particles of silicon carbide. Such deposit has been known for some time and has been used for various products including rotor housings for rotary engines. However, such deposit has been invariably applied by a direct electrolytic method that is directly on the housing itself or other end product.

The prior art has not appreciated how to prepare a transplant liner by electrolytic techniques which will effectively bond to a casting thereabout. Nor has the prior art appreciated how to utilize and electrolytically deposit such wear-resistant materials as nickel-silicon carbide in functional thicknesses greater than 0.02 inches which will not deteriorate under a severe heat stress environment. Nor has the prior art appreciated how to impart a superior smooth as-deposited surface to a rotor housing to obviate substantial machining.

SUMMARY OF THE INVENTION

The primary object of this invention is to provide an improved method for fabricating composite rotor housings for rotary engines, the method using the transplant and electrolytic deposition techniques, both in a unique combination.

Another object of the invention is to provide a method of preparing a composite rotor housing characterized by a high coefficient of heat transfer, substantially no porosity in the liner of such housing, an inner surface which is extremely wear-resistant and has a smooth as-cast surface, and an effective adherent mechanical bond between the portions of the composite housing.

A more specific object of this invention is to provide a technique of fabricating a composite rotor housing by electrolytically depositing a nickel-silicon carbide material onto a conductive mandrel serving as a cathode, the deposition being controlled to provide a unique thickness range and outer surface roughness. The coated mandrel is placed in a die-cast machine for casting aluminum therearound. The mandrel is stripped from the coating leaving the composite rotor housing.

Still another object is to provide a method of making a rotor housing which will not only provide a more wear-resistant structure but which is accomplished at a lower cost and with less materials.

BRIEF DESCRIPTION OF THE DRAWINGS

FIG. 1 is a flow diagram illustrating schematically the steps involved in a preferred embodiment of the inventive method herein;

FIG. 2 is a schematic illustration of the solidification structure of a typical rotor housing according to the prior art; and FIG. 3 is another schematic illustration similar to FIG. 2, depicting a fragment of the solidification structure of a rotor housing according to this invention.

DETAILED DESCRIPTION

Turning now to the schematic flow diagram of FIG. 1, a preferred sequence is illustrated. In Step 1, a mandrel 10 is prepared from a suitable core material capable of being machined to a very exact complex configuration, such as an epitrochoid surface 11. The epitrochoid surface is required by the internal wall of a rotor housing for a rotary internal combustion engine. The epitrochoid surface 11 is a mirror image of the resultant epitrochoid surface to be structured on the rotor housing of the engine. A suitable material for this purpose is a chrome-bearing steel with a chromium content in the range of 3–25%. The chromium content enables the material to be passivated thereby facilitating non-adhesion between the mandrel and the material to be deposited thereover. In addition, the mandrel may be tapered in a direction from one end to the other to facilitate stripping subsequent to Step 3. The surface 11 must have a surface roughness of 4–12 r.m.s. which may be imparted by machining and polishing.

In Step 2, the mandrel is placed in an electrolyte for the purpose of electrolytically depositing a cermet coating consisting of nickel with carbide particles. The cermet may be constituted of a base material selected from either iron or a copper alloy, and further comprised of ceramic particles suspended therein, each selected from the group consisting of carbides of silicon or tungsten, oxides of aluminum or iron, and diamond. The resultant electrolytic coating will define a sleeve 12 about the mandrel. The composition of the electrolyte for depositing the nickel-based cermet is not critical; however, the following range of ingredients has been found to be conveniently controlled: Nickel sulfamate in the range of 200–600 grams per liter, $NiCL_2$ – 6 $H_2O$ in the range of 30–70 grams per liter, and $H_3Bo_4$ in the range of 20–40 grams per liter. Silicon carbide, being among the hardest materials, is preferred because it combines high hardness with low cost in a most desirable manner. The hard particles are introduced to the electrolyte in an amount in the range of 100– 150 grams per liter and in a particle size range of 0–10 microns; the particles are held dispersed in the electrolyte by agitation. A PH value for the electrolyte is selected according to other process variables and may be between 3 and 5 in a conventional manner. The temperature of the electrolyte may be about 160°F.

Most critically, the current density is sequentially staged to be in the range of 50–100 amps per square foot initially, or for a few starting moments of the deposition step. Next, the current density is raised to 400–1000 amps per square foot for the remainder of Step 2. By so doing, the roughness of the outer surface of coating 12 is controlled whereby projections appear on major portions of the outer surface having a height no less then 0.030 inches and in a concentration number of at least 5 per cm². The outer surface 12*a*, accordingly, has a roughness controlled to be at least 250 times more rough than the mandrel surface 11 and thereby also more rough than the inner side 12*b*. Electrolytic nickel is the preferred anode material.

The deposited coating 12 is in the thickness range of 0.01–0.04 inches, preferably 0.025 inch, and has a porosity of substantially zero. This is in high contrast to the characteristic porosity of a sprayed coating which has a minimum of 5%. The porosity of a sprayed coating is detrimental to heat transfer in that it forms a barrier at the very location in the rotor housing where heat must be transmitted. The lack of porosity and a denser material affords greater heat transfer.

The eventual casting of aluminum directly about such a coating 12 encounters certain problems. The surface tension of aluminum is considerably high and must be lowered to effectively wet and metallurgically adhere to the non-porous coating 12. One technique used by the prior art is to employ sandblasting to lower such surface tension, creating a highly rough surface for the coating. However, this has not proved successful because of cost and lack of adequate control. A principal feature of this invention is to characterize the roughness of the outer surface 12*a* of coating 12 so that it is more discontinuous than a sandblasted surface, and accordingly, it becomes very efficient as a wetting medium for the aluminum to be cast therearound.

In Step 3, the mandrel and sleeve coating 12 is placed in a die-cast machine 14 having a suitable cavity 15 which receives the outer coating 13 in a predetermined spaced manner. An aluminum-based alloy is injected into the molding cavity about the assembly to form a casting 16 which is principally bonded to coating 12 by virtue of a mechanical lock. The mechanical lock equivocating at least 95% of a true metallurgical bond achieved solely by mutual solubility. In addition, the heat of the casting material penetrates the coating 12 to effect a slight degree of alloying between the nickel base and the aluminum. The aluminum-based alloy may contain an amount of silicon (4–16%, preferably 10% silicon) and may also contain copper (preferably 3%). The cast material may be selected from the group consisting of aluminum, aluminum-based alloys, iron and magnesium.

In Step 4, the mandrel 10 is stripped from the coating 12 leaving the resulting composite rotor housing consisting of the casting 12 mechanically locked to the liner or coating 12. The inner surface 12*b* of the coating 12 has a deposited surface roughness of 4–12 r.m.s. Depending upon the degree to which the mandrel surface has been polished. If the mandrel surface has a surface roughness of about 24 r.m.s., then approximately 5 mils of the coating is machined or removed to produce the 4-12 range of surface roughness.

The advantages of the above fabricating method comprise the following: (a) There is less removal of asdeposited material according to this method. In the popular transplant technique utilizing a sprayed coating of plain carbon steel, the steel is sprayed in an extremely heavy thickness in the range of 80–90 mils and then approximately 30–35 mils of such spray coating is removed to define a sufficiently smooth inner surface. In addition, hard chrome is placed upon the sprayed coating to introduce sufficient wear-resistance. In contrast, the inventive method provides precision electroplating of only a few mils (and then, in most cases, no material is removed or at best 5 mils are ground off). (b) There is no heat transfer penalty. In the popular transplant technique where sprayed steel is applied, there is a steep-thermal barrier as the result of the highly porous spray coating. (c) There is a stronger adherent bond between the constituents of the composite housing. The coating of the inventive method herein is extremely smooth at the mandrel inter face and extremely rough on the side of the coating exposed to the aluminum casting. This differential roughness imparts the proper operating characteristics to each side. (d) The coating of the method herein is more ductile. The nickel-based material, with embedded silicon carbide, is extremely ductile and tough, unlike the typical prior art coating utilizing the brittle chrome outer surface. (e) The method herein has increased speed of productivity. The method herein allows for high speed die-cast methods to be incorporated, rather than being restricted to semi-permanent low pressure mold casting. (f) The method herein is more economical in overall cost. Because several preparation steps are eliminated and because more controlled use of material is insured, the overall unit cost of producing a rotor housing according to the inventive method is lower.

We claim:

1. A method of preparing a coated rotor housing for a rotary internal combustion engine comprising:

a. defining a conductive mandrel having an outer surface complimentary to the resultant rotary housing surface, b. electrolytically depositing a functional coating of a composite particle wear-resistant material onto said mandrel to form an assembly, the exposed surface of said assembly having a roughness characterized by projections at least 0.030 inches and concentrated in a number of 5–100 per cm², c. casting a molten metallic material about said assembly, the casting material upon cooling being predominantly mechanically locked to said assembly, and d. stripping said mandrel from said coating.

2. A method as in claim 1, in which the as-deposited coating is characterized by a thickness in the range of 10–40 mils.

3. A method as in claim 2, in which the as-deposited coating is subjected to a finishing operation where no greater than 5 mils of said coating thickness is removed by machining.

4. The method as in claim 1, in which the composite particle wear-resistant material is comprised of a deposit of nickel containing a distribution of 2–8% silicon carbide particles having an average grain size of approximately 1 micron.

5. The method as in claim 4, in which the electrodeposited nickel material has fine particles of silicon carbide dispersed and oriented therein so that the hardness of the coating is in the range of 70–100 $R_c$.

6. A method as in claim 1, in which the exposed surface of said assembly has a predetermined roughness obtained by maintaining the current density for said electrolytic deposition step initially in the range of 40–100 amps./ft$^2$ and subsequently raising said current density to 400–1000 amps./ft$^2$.

7. The method as in claim 1, in which an electrolyte for the electro deposit step comprises a concentration of nickel sulfamate and nickel chlorhydrate, the silicon carbide particles being present in the electrolyte in the amount of about 100–150 grams per liter of electrolyte, the PH value being maintained in the range of 3–5 and the temperature being between ambient and 70°C.

8. The method as in claim 1, in which the resultant coating is substantially mechanically locked to said cast material, the electrolytically deposited coating having a porosity of substantially 0.

9. The method as in claim 1, in which the exposed surface resulting from step (d) of said coating has an interior surface roughness in the range of 4–12 r.m.s.

* * * * *